US007360739B1

(12) United States Patent
Horvat

(10) Patent No.: US 7,360,739 B1
(45) Date of Patent: Apr. 22, 2008

(54) SWIVEL TOILET PAPER DISPENSER

(76) Inventor: Frank Horvat, 1233 Nielsen, St-Hubert, Quëbec (CA) J4T 1N2

( * ) Notice: Subject to any disclaimer, the term of this patent is extended or adjusted under 35 U.S.C. 154(b) by 0 days.

(21) Appl. No.: 11/643,370

(22) Filed: Dec. 20, 2006

(51) Int. Cl.
*B65H 18/02* (2006.01)

(52) U.S. Cl. ..... 242/591; 242/598.4

(58) Field of Classification Search ..... 242/591, 242/592, 594.3, 598.4, 598.5
See application file for complete search history.

(56) References Cited

U.S. PATENT DOCUMENTS 1,474,873 A * 11/1923 Woodward
1,538,477 A * 5/1925 Epstein
2,989,257 A * 6/1961 Schuler et al.
5,179,972 A * 1/1993 Eley
6,588,444 B2 * 7/2003 Paplow et al.
7,090,106 B2 * 8/2006 Holden

* cited by examiner

*Primary Examiner*—William A Rivera
(74) *Attorney, Agent, or Firm*—Eric Fincham

(57) ABSTRACT

A toilet paper dispenser which comprises an L-shaped member having a first mounting portion for securement to either horizontal or vertical substrate and a second portion extending outwardly therefrom, a toilet paper holder mounted to the second portion, the toilet paper holder being pivotable through 180°.

9 Claims, 2 Drawing Sheets

SWIVEL TOILET PAPER DISPENSER

FIELD OF THE INVENTION

The present invention relates to a holder and more particularly, relates to a holder for a roll of toilet paper.

BACKGROUND OF THE INVENTION

A typical type of holder for toilet paper rolls consists of a receptacle or housing, usually of a semi-cylindrical form recessed into a wall and having in its opposite interior faces sockets or slots to receive the ends of a horizontally disposed journal rod or core upon which the paper roll is mounted. Because of its recessed position, the removal of paper from the roll is sometimes awkward, particularly when the holder is in a wall on one side of the toilet causing the axis of rotation of the roll to be substantially parallel to the general direction of the arm reach of the user.

In order to overcome the above problems, various different types of holders for a roll of toilet paper have been advanced in the art. Thus, for example, in U.S. Pat. No. 4,824,038 there is provided an arrangement wherein the holder includes a cylindrical core which pivotably engages a lower extremity of the frame such that the core can be swung in a vertical path between a vertical position and a horizontal position.

In U.S. Pat. No. 4,416,425 to Kish, there is disclosed a paper roll dispenser which has a bracket with two generally parallel elongated support arms extending therefrom in a direction generally perpendicular to a front face of the bracket such that each support arm is free to rotate about its arm axis. A spindle has one end attached to each of the support arms to rotatably support a roll of paper between the support arms. The roll is replaced by rotating one support arm about its arm axis and thereby moving the spindle into a position projecting generally away from the other support arm whereby the spent roll supported by the spindle may be replaced.

U.S. Pat. No. 2,555,531 to Boord teaches a dispenser which comprises a pair of supporting arms extending outwardly from a mounting bracket then the outer ends are bent upwardly to form parallel prongs. Each prong is designed to receive a roll of toilet paper mounted thereon.

U.S. Pat. No. 3,227,386 teaches a holder for toilet paper rolls wherein the holder may be mounted in different positions to orient the roll in different directions either horizontal or vertical.

While the above references disclose many different possible arrangements, they fail to teach an arrangement wherein a universal support member may be mounted on either a horizontal or a vertical surface and wherein a roll of toilet paper or the like may be dispensed in different orientations.

SUMMARY OF THE INVENTION

According to one aspect of the present invention there is provided a toilet paper dispenser comprising an L-shaped member, the L-shaped member having first and second mutually perpendicular portions, the first portion having means associated therewith for securing the same to a substrate, the second portion having means for receiving a toilet paper holder, the holder having a base and a pair of arms extending outwardly from the base, the arm being arranged to receive a rod and toilet paper roll, the base being pivotably connected to the second portion of the L-shaped member, the holder being rotatable through 180°.

According to a further aspect of the invention in a toilet facility having a toilet paper dispensing device, the improvement wherein the dispensing device comprises a toilet paper holder comprising an L-shaped member, the L-shaped member having first and second mutually perpendicular portions, the first portion being secured to a substrate, the second portion having means for receiving a toilet paper holder, the holder having a base and a pair of arms extending outwardly from the base, the arm being arranged to receive a rod and toilet paper roll, the base being pivotably connected to the second portion of the L-shaped member, the holder being rotatable through 180°.

The holder according to the present invention may be manufactured of any suitable material including the conventional choice of metallic and plastic materials and/or combinations thereof.

As mentioned above, the holder includes a bracket member which comprises two mutually perpendicular arms. One of the arms is designed to be mounted to a substrate which could either be a horizontal or a vertical surface. The holder may be mounted by any conventional means including mechanical fasteners such as are conventionally employed.

The yoke-like member comprises a back portion and two arms extending outwardly therefrom, the two arms being designed to hold a rod or core about which the roll of toilet paper is placed in a conventional manner.

BRIEF DESCRIPTION OF THE DRAWINGS

Having thus generally described the invention, reference will be made to the accompanying drawings illustrating an embodiment thereof, in which.

DETAILED DESCRIPTION OF THE INVENTION

Figure 1:
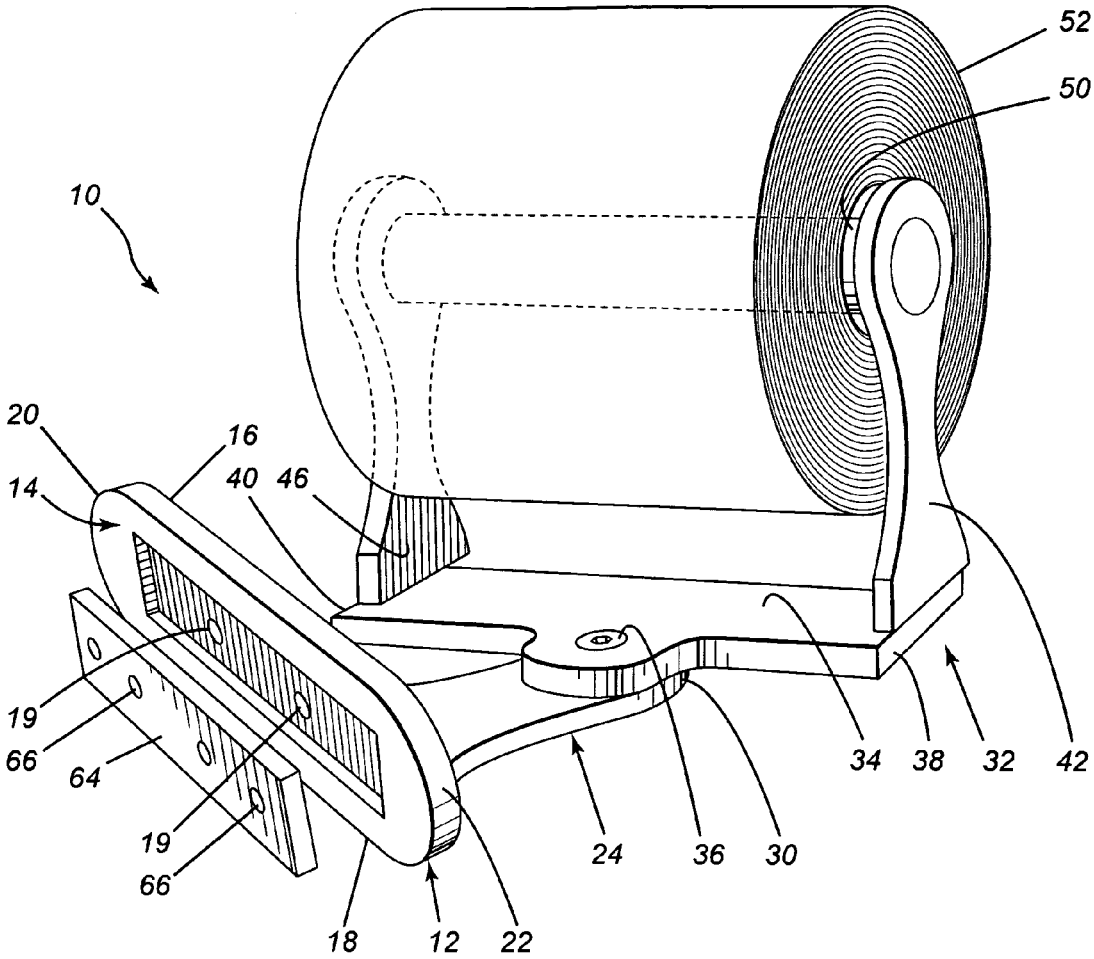
FIG. 1 is a perspective view of a dispensing device according to the present invention.

Referring to the drawings in greater detail and by reference characters thereto, there is illustrated in FIG. 1 a toilet paper dispensing device which is generally designated by reference numeral 10.

Dispensing device 10 has a first bracket member generally designated by reference numeral 12. Bracket member 12 includes a first mounting portion 14 and which mounting portion 14 has a relatively straight upper marginal edge 16 and a lower marginal edge 18. Arcuate end edges 20 and 22 extend between the upper and lower marginal edges. Apertures 19 are provided to receive attachment screws.

A second portion of bracket member 12 is an arm 24. Arm 24 extends outwardly substantially perpendicular to mounting portion 14 and is secured to mounting portion 14 at end marginal edge 28 which abuts top marginal edge 16 of mounting portion 14. In this respect, it will be noted that the base 26 of arm 24 is narrower than upper marginal edge 16 and tapers inwardly to form a distal end portion 30.

A toilet paper holder generally designated by reference numeral 32 includes a base portion 34 which is secured to distal end 30 of arm 24 at pivot point 36. Preferably, the arrangement is such that base 34 can pivot through 90° in either direction from the position shown in FIG. 1. To this end, suitable detents may be provided to secure toilet paper holder 32 in one of the three positions.

Extending upwardly from end marginal edge 38 of base 34 is an arm 42. Similarly, on the other side, an arm 46 extends upwardly from end marginal edge 40.

Each of arms 42 and 46 have a recess formed on the facing sides. The recesses are designed to receive a conventional spring loaded rod 50 upon which a roll of toilet paper 52 has been placed.

Figure 2:
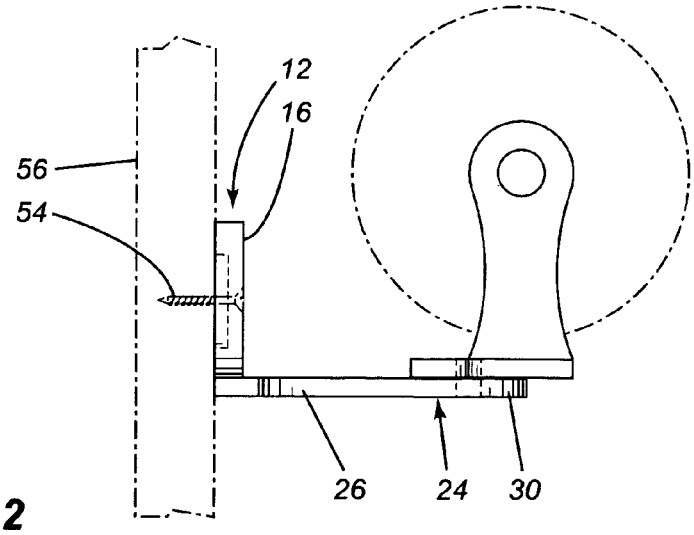
FIG. 2 is a top plan view thereof when the device is mounted on a vertical surface.
Figure 3:
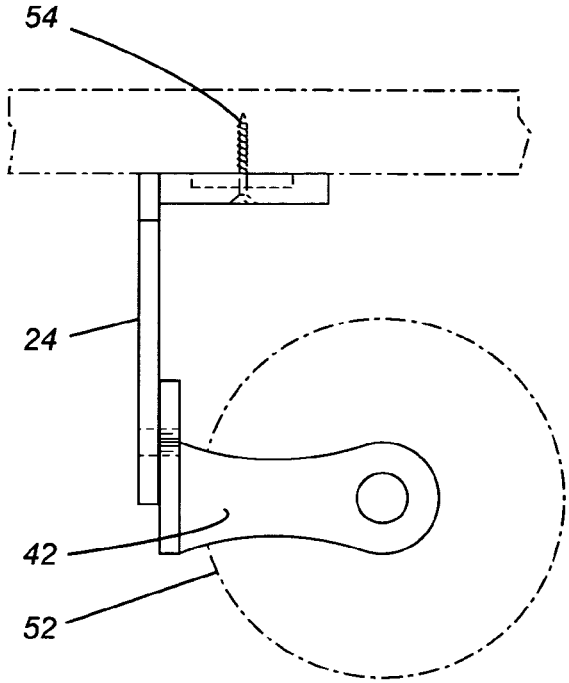
FIG. 3 is a side elevational view thereof.
Figure 4:
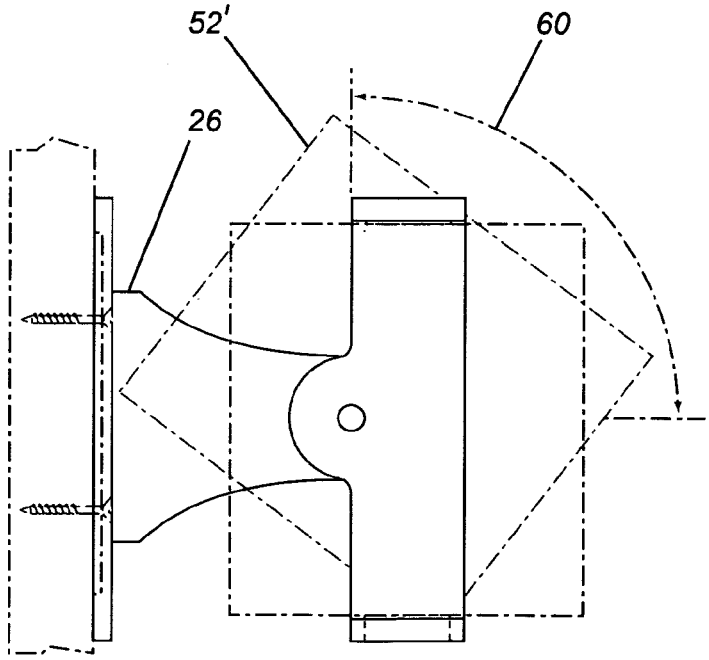
FIG. 4 is a side elevational view when the device is mounted on a horizontal surface.

As shown in FIGS. 2 and 3, device 10 may be mounted to a vertical substrate 56 by means of mounting screws 54. Alternatively, as shown in FIG. 4, device 10 may be mounted to a horizontal substrate such as the underside of a counter by means of screws 54. A mounting plate 64 with apertures 66 may be provided.

FIG. 4 illustrates the pivoting movement of holder 32. Thus, the holder may be rotated through 90° as indicated by arrow 60 such that the base is in a position perpendicular to the original position and the toilet paper roll moves position as indicated by reference numeral 52'. As will be understood, the holder 32 may be rotated through 90° in the other direction.

It will be understood that the above described embodiment is for purposes of illustration only and that changes and modifications may be made thereto without from the spirit and scope of the invention.

I claim:

1. A toilet paper dispenser comprising:

an L-shaped member, said L-shaped member having first and second mutually perpendicular portions, said first portion having means associated therewith for securing the same to a substrate;

said second portion having means for receiving a toilet paper holder;

said holder having a base and a pair of arms extending outwardly from said base, said arm being arranged to receive a rod and toilet paper roll, said base being pivotably connected to said second portion of said L-shaped member, said holder being rotatable through 180° in a plane parallel to a longitudinal axis of said second portion.

2. The dispenser of claim 1 wherein said dispenser is formed of a moulded plastic material.

3. The dispenser of claim 1 wherein said dispenser is formed of a metallic material.

4. The dispenser of claim 1 wherein said means associated with said first portion for securing the same to a substrate comprises a pair of apertures formed therein designed to receive screw threaded members.

5. The toilet paper dispenser of claim 1 wherein said second portion has a proximal end secured to said first portion and a distal end, said distal end being narrower than said proximal portion.

6. In a toilet facility having a toilet paper dispensing device, the improvement wherein said dispensing device comprises:

a toilet paper holder comprising:

an L-shaped member, said L-shaped member having first and second mutually perpendicular portions, said first portion being secured to a substrate;

said second portion having means for receiving a toilet paper holder;

said holder having a base and a pair of arms extending outwardly from said base, said arm being arranged to receive a rod and toilet paper roll, said base being pivotably connected to said second portion of said L-shaped member, said holder being rotatable through 180° in a plane parallel to a longitudinal axis of said second portion.

7. The improvement of claim 6 wherein said first portion is secured to a vertical substrate.

8. The improvement of claim 6 wherein said first portion is secured to an underside of a horizontal substrate.

9. The improvement of claim 6 wherein said first portion is secured to said substrate by a plurality of screws.

* * * * *